United States Patent [19]

Nolan

[11] Patent Number: 4,512,043

[45] Date of Patent: Apr. 23, 1985

[54] PORTABLE HAIR SHAMPOO AND SCALP TREATMENT BASIN

[76] Inventor: William D. Nolan, 3105 Grant St., Wichita Falls, Tex. 76308

[21] Appl. No.: 482,042

[22] Filed: Apr. 4, 1983

[51] Int. Cl.[3] ..... A54D 19/04

[52] U.S. Cl. ..... 4/516; 4/523; 132/9

[58] Field of Search ..... 4/516–523; 128/65, 66; 132/9

[56] References Cited

U.S. PATENT DOCUMENTS

| | | | |
|---|---|---|---|
| 2,507,630 | 5/1950 | Green | 4/517 |
| 2,818,585 | 1/1958 | Campbell | 4/523 X |
| 2,854,969 | 10/1958 | Nolan | 4/518 X |
| 2,854,970 | 10/1958 | Nolan | 4/517 X |
| 3,068,491 | 12/1962 | Perekrestenko | 4/516 |
| 3,192,537 | 7/1965 | Coffman et al. | 4/516 |
| 3,579,656 | 5/1971 | Guarrasi | 4/519 |
| 3,894,546 | 7/1975 | Nolan | 128/65 X |
| 4,407,028 | 10/1983 | Nolan | 4/516 |

*Primary Examiner*—Charles E. Phillips
*Attorney, Agent, or Firm*—Warren H. Kintzinger

[57] ABSTRACT

A shampoo and scalp treatment basin in rectangular closed box-like form in the portable state and with the removed top connected to the head receiving end of the basin box and acting as a sloped back rest support for the person receiving a hair shampoo and scalp treatment. There is a half moon cut out at the top of the end wall of the head receiving end of the basin box to accommodate the neck of the user. The basin box top when serving as a back rest is connected to the front end wall of the basin box by hook connectors mounted in wall openings and engaging straps mounted on the back rest top. The basin box has screw head openings toward the top of each of the two sides and in the rear wall of the basin box for support attachment to a wall with wall mounted screws when used in a mounted state rather than on a bed, floor, treatment table or chair. A drain hose from the basin can run to a bathtub, commode or pail (whatever is handy). The interior of the basin box has a cavity open to the top forming a basin for shampooing the hair and treatment of the scalp and a utility cavity and a basin drain opening with a connection for the drain hose. A labyrinth water reservoir container is also provided in the basin box structure with a double wall like construction with an upper opening for feeding of water to the reservoir and through which a water suction line extends down into the reservoir water. A pump, that may be a hand pump, is connected to suck water through the water suction line and feed water under pressure to one or the other of two nozzles as controlled by a valve to spray wet the hair and scalp.

16 Claims, 4 Drawing Figures

PORTABLE HAIR SHAMPOO AND SCALP TREATMENT BASIN

Figure 1:
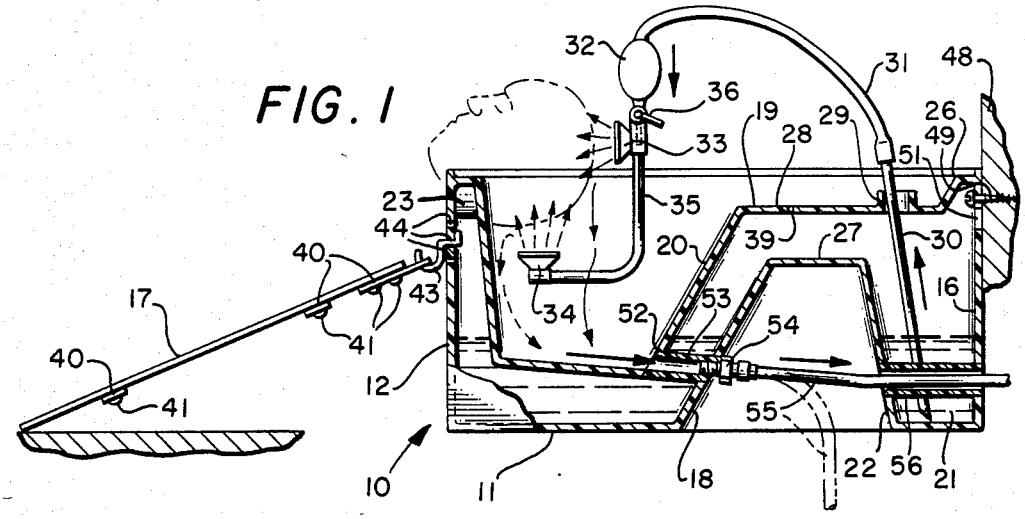

This invention relates in general to shampoo and scalp treatment basins, and more particularly, to a portable rectangular box like shampoo basin with a box enclosure top also useable as a back rest and a water reservoir supplying water through a pump to hair and scalp spray nozzles.

Many hair shampoo and scalp treatment basins are heavy permanently fixed in place installations with heavy metal sink basins with special chairs required to support a person having a hair shampoo and scalp treatemnt. Such heavy fixed in place installations are generally found in beauty parlors and barber shops and not in the home, retirement home or invalids hospital room. These large and complex fixed in place installations are expensive to make and install, freely use water and require a special shampoo chair for the user.

It is therefore a principal object of this invention to provide an efficient, portable substantially self contained hair shampoo and scalp treatment basin.

Another object for such a shampoo and scalp treatment basin is easily transportable, having an internal water reservoir fillable on location, and placeable on a bed in the home or hospital bed for use by persons confined to bed.

A further object is to provide such a portable shampoo and scalp treatment basin structured for partial support on any of two sides or the rear wall from walls in the close quarters of kitchens, bathrooms, utility rooms, resthomes and hospitals.

Still another object is to provide such a shampoo and scalp treatment basin in compact form, easy to carry like luggage, having space inside to carry work equipment such as combs, brushes, blow dryers and other tools of the trade used by a professional beauty consultant going to out of beauty salon locations.

Another object is to provide such a shampoo and scalp treatment basin with a removable enclosure top useable as a back support for a user that is useable either sideways or longways as may be dictated by back length of different sized users.

A further object is for this shampoo basin unit to be an inexpensive home shampooer yet high quality unit adapatble for beauty and barber shops merely by installing appropriate fixtures and connecting the drain.

Features of the invention useful in accomplishing the above objects include, in a new improved useful portable hair shampoo and scalp treatment basin, a unit package in rectangular closed box-like form with handles for easy carrying like luggage when in the closed portable state. The unit includes a removable top that may be connected to the head receiving front end of the basin box to act as a sloped back rest support for the person receiving a hair shampoo and scalp treatment. A half moon cut out in the top of the front head receiving end wall presents a rest surface for the users neck. Hook connectors and top straps interconnect the box front end and the box top when it is being used as a sloped user back rest. Basin box wall screw head keyed openings toward the top of each of two sides and/or in the rear wall of the box provide for screw attachment support to a wall when the box is used in a mounted state rather than on a bed, floor, treatment table or chair. The drain hose from the basin may be run conveniently to a bathtub, commode or pail, or other plumbing fixture (whatever is handy). The basin box has an internal cavity open to the top forming a basin for shampooing the hair and treatment of the scalp with utility cavity space and a basin drain opening with a connection for a drain hose. A water reservoir is provided in the basin box with a double wall like construction having an upper opening for feeding of water to the reservoir and through which a water section line extends down into the reservoir water. A pump, that may be a hand pump, is connected to suck water through the water suction line and feed water under pressure to one or the other of two nozzles as controlled by a valve to spray wet the hair and scalp.

A specific embodiment representing what is presently regarded as the best mode of carrying out the invention is illustrated in the accompanying drawing.

Figure 2:
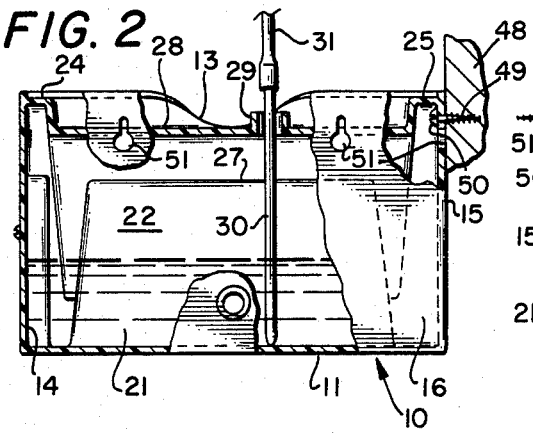
Figure 4:
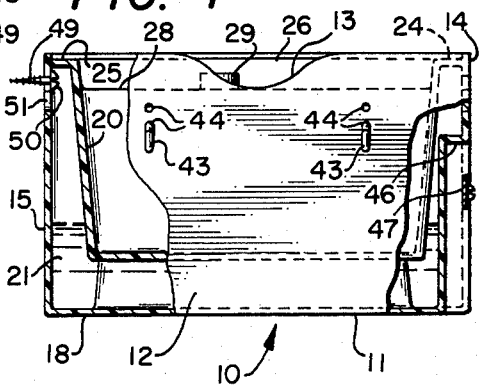
Figure 3:
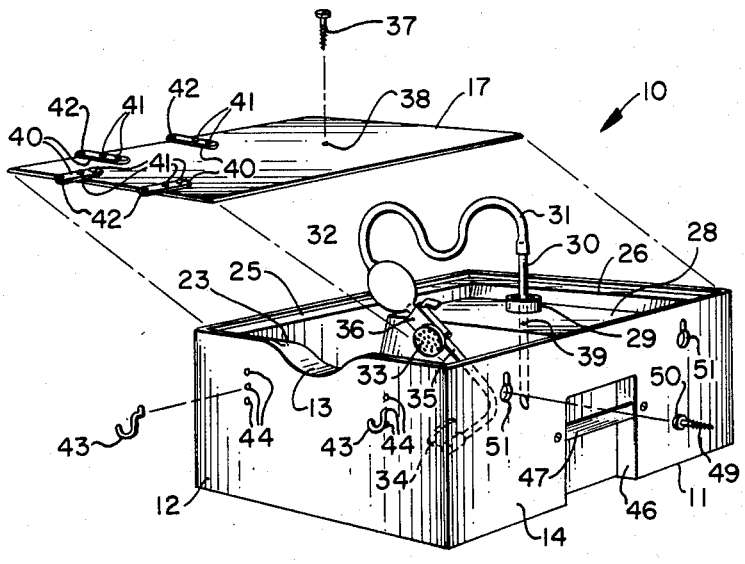

In the drawing:

FIG. 1 is a partially broken away and sectioned side elevation view of the hair shampoo basin and scalp treatment unit as set up for use;

FIG. 2, a partially broken away and sectioned rear elevation of the hair shampoo basin and scalp treatment of FIG. 1;

FIG. 3, a perspective view of the unit with the top cover lifted up and away showing additional detail of the unit; and, FIG. 4, a partially broken away and sectioned front elevation view of the shampoo and scalp treatment basin unit.

Referring to the drawing:

The portable hair shampoo and scalp treatment basin 10 of FIGS. 1–4 is shown to be a rectangular box like structure having a generally flat bottom 11 and a front head receiving end 12 having a half moon cut out 13 at the top to accommodate and as a rest for the neck of the user. The basin box 10 also has opposite sides 14 and 15 and a rear wall 16 and a removeable top cover 17 which is seated on the box by a peripheral rim, said cover also functions as a back rest when connected to the box basin 10 for user support. The basin box is a double wall like construction with the bottom 11 end 12, opposite sides 14 and 15 and rear wall 16 together forming an outer wall 18 of the double wall like construction and wall 19 forming the inner wall thereof. Inner wall 19 is formed with a front end basin portion 20 beneath a users head when the users hair and scalp is being sprayed with water. The spacing between outer wall 18 and inner wall 19 with their various molded configurations provide a water reservoir 21 extending through substantially the length of the basin box and around an upwardly formed cavity 22 molded in outer wall 18 to extend upward from bottom 11 to the rear of basin portion 20. The inner wall 19 at the forward end is provided with an interconnect section 23 to outer wall 18 including the half moon cut out 13 to give, through an extended area, good support to a users neck. The inner wall 19 is connected to side walls 14 and 15 at the top via interconnect sections 24 and 25 respectively, and to rear wall 16 at the top via interconnect section 26. Spaced from the top 27 of cavity 22, and positioned vertically between the cavity top 27 and the basin box top, inner wall 19 is formed with convenience tray 28 extending to the rear from the basin portion to connection with the rear wall interconnect section 26.

The basin box structure is molded from typically a strong durable plastic with inner wall 18 and outer wall 19 sections molded independently and then plastic welded together to the assembled state shown. A water fill boss opening 29 is mold formed toward the rear of convenience tray 28 through which water is poured to reservoir 21 and through which suction pipe 30 is inserted for the drawing of water through suction pipe 30 and flexible line 31 as drawn by manually actuated hand pump 32 (other pump structures could be used). Water as driven under pressure from hand pump 32 is sprayed from spray nozzle 33 or spray nozzle 34 mounted on rigid nozzle pipe structure 35 as selected by nozzle selection control valve 36 located adjacent hand pump 31. The beauty consultant, barber or other professional using the basin for giving a user a shampoo and scalp treatment is free to move the pump and spray nozzles 33 and 34 around as one is manually operating hand pump 32 and selecting nozzle 33 or nozzle 34 for spraying by setting of valve 36 with the flexible water line 31. This optimizes pressure spray of water during hair and scalp wetting and then rinsing in completing a shampoo and scalp treatment. During a shampoo and scalp treatment between the hair and scalp wetting and the rinsing operations the nozzle pipe structure with nozzles 33 and 34 and hand pump 32 may be conveniently laid back out of the way on the top of convenience tray as permitted by the flexible line 31. The shampoo box top cover 17 is held nested in place on the box top by a screw 37 extended through top cover opening 38 and threaded into screw opening 39 in convenience tray 28. The top cover 17 is also equipped with four identical straps 40 that are fixed thereon by rivets 41, or other suitable fastening means, two projecting on one end and two projecting to one side with openings 42 in the strap ends mounting the two end straps or two side straps on hooks 43. Hooks 43 in turn are mounted in a selected heighth opening 44 in the front end wall 12 to suit the size of a patient as is also the reason for mounting the top cover 17 from the end or the side as a back rest for a user in bed 45 or on a service table or the like.

Side 14 is provided with a molded in place pocket 46 with a handle 47 extended there across for ease in carrying like luggage in the assembled state with top cover 17 fastened in place by screw 37, and with tools of the trade and the water pumping parts pipe 30, line 31, pump 32, nozzles 33 and 34 and pipe structure stored in the basin portion 20. Sides 14 and 15 and the rear end wall 16 of the basin box may, selectively, be fastened to a room wall 48 as shown in FIGS. 1 and 2 by screws 49 with screw heads 50 received in keyed openings 51 in respective box walls. This is useful for partial support from walls in the close quarters of kitchens, bathrooms, utility rooms, resthomes and hospitals.

A basin portion drain opening 52 is connected through a plastic pipe 53, plastic welded in place between outer wall 18 in cavity 22 and inner wall 19 in basin portion 20, to a threaded coupling 54 connection to water drain hose 55 that may be extended straight down out of cavity 22, as indicated in phantom, or across the cavity 22 to and through a plastic pipe 56, plastic welded in place, extended from cavity 22, the rear of the water reservoir 21 and through rear wall 16. The drain hose 55 can be dropped straight down as indicated in phantom in FIG. 1 when the shampoo basin device is supported from either of its two side walls or the rear wall or through the plastic pipe 56 and out of the rear wall 16 when the basin device box is resting on its bottom on a bed, table or other flat surface, and run conveniently to a bathtub, commode or pail or other plumbing fixture (whatever is handy for a drain).

When the portable hair shampoo and scalp treatment basin is used on a bed for a user confined to bed the water reservoir 21 is filled through opening 29 to a reasonable degree but not so high as to leak from openings 44 in the front wall 12 or the keyed openings 51 in the box walls. The hooks 43 are placed in the desired heighth opening 44 for the proper sloping positioning of top cover 17 when connected to the hooks 43. The drain hose 55 is passed through pipe 56 and to a convenient drain. Hand pump 32 is then used to wet the users hair via the rigid nozzle pipe structure 35. Then with the nozzle pipe structure 35 laid aside on convenience tray 28 shampoo is applied and the users head is manually shampooed by the operating beautician, barber or other professional. The pump 32 and nozzle pipe structure 35 is then used to rinse the hair and scalp. Obviously, hair and scalp treatment materials may be added to water in the water reservoir 21. The shampoo basin device may be attached to a stand with screws, as shown for a wall, with the stand moveable around and placeable for convenience near a bathtub, wash basin or commode whatever is handy as a drain. In some of the wall mount or stand mounted instances a chair without an armrest is placed sideways and the back support 17 placed with an end resting on an edge of the seat of the chair. The user sits on the chair and leans back on the back support placing their neck into the neck cut out 13 and with the head projecting into the top of the basin portion of the shampoo and scalp treatment basin 10 for the shampooing and scalp treatment sequence.

Whereas this invention has been described with respect to a single embodiment thereof, it should be realized that various changes may be made without departing from the essential contribution to the art made by the teachings hereof.

I claim:

1. A portable hair shampoo and scalp treatment basin comprising: a box structure having, a removable top, a bottom, two opposite sides, a back end, and a front end, and with said box being generally of double spaced wall construction having, an outer wall and an inner wall; said outer wall forming said bottom, two opposite sides, the back end, and the front end; said inner wall is connected to said outer wall near the top of said box structure by a peripheral interconnect surface which serves to support said inner wall in a spaced relationship with respect to said outer wall and thus forms a water reservoir between said two walls, said inner wall is formed with a basin cavity at the front user head receiving end of said box structure, and with a convenience tray portion extending generally from the rear of said basin cavity to said interconnect means at the rear of said structure; opening means in said tray portion through which water may be fed to said water reservoir; a rounded cut out in the top of the front end of both said outer and inner walls with said interconnect surface following the contour of said cutout to form a user neck rest mount means for connecting an edge of said removable top to said front end below said cutout to serve as a sloped back rest for a user during a hair shampoo and scalp treatment; wherein fluid drain means extends from said basin cavity through said inner wall and said outer wall and through space between said inner wall and said outer wall; and said water reservoir extending through substantially the length of the basin box and around said basin cavity formed in said inner wall.

2. The portable hair shampoo and scalp treatment basin of claim 1 wherein said fluid drain means includes a pipe extending from said basin cavity through the space between said inner wall and said outer wall; and a flexible drain hose connected through hose to pipe connective means for draining of used water from said basin to a receiving drain of convenience.

3. The portable hair shampoo and scalp treatment basin of claim 2, wherein said basin box structure is molded generally from strong durable plastic with said inner and outer wall sections molded independently and then plastic welded together to the assembled state.

4. The portable hair shampoo and scalp treatment basin of claim 3, wherein said outer wall is molded with an upwardly formed cavity from the said bottom of said box structure; and with said fluid drain means extended into said upwardly formed cavity and with said flexible drain hose extended from said cavity to a receiving drain of convenience.

5. The portable hair shampoo and scalp treatment basin of claim 4, wherein said box structure is provided with a pipe passage extended through said outer wall twice and a portion of said water reservoir with said flexible drain hose extended through said pipe passage for drain convenience when the portable hair shampoo and scalp treatment basin is being used on a bed or other flat surface precluding extension of said flexible drain hose from said cavity to a receiving drain of convenience.

6. The portable hair shampoo and scalp treatment basin of claim 4, wherein a suction pipe and flexible line and pump means interconnect said water reservoir, with said suction pipe inserted through said opening means in said inner wall, to a nozzle structure.

7. The portable hair shampoo and scalp treatment basin of claim 6, wherein said nozzle structure includes a plurality of spray nozzles; and valve means for controlled passage of water selectively to individual nozzles.

8. The portable hair shampoo and scalp treatment basin of claim 6, wherein said pump means is a hand pump; and with said flexible line being of sufficient length to permit the operator of the unit to spray water on a users hair and scalp initially and then placing the said nozzle structure back on said convenience tray portion while shampooing the users hair and then spraying water again on the users hair and scalp above said basin in the final hair and scalp rinse function.

9. The portable hair shampoo and scalp treatment basin of claim 8, wherein said box structure is formed with a top receiving rim around the upper periphery thereof for receiving said removeable top therein; and fasten down means for said removeable top when in place on the top of said box.

10. The portable hair shampoo and scalp treatment basin of claim 9, wherein said fasten down means includes a screw or bolt extended through an opening in said removeable top and threadable into a threaded opening in said convenience tray portion of said inner wall.

11. The portable hair shampoo and scalp treatment basin of claim 9, wherein said removeable top is provided with a plurality of strap elements mounted thereon; and said mount means for connecting on edge of said removeable top to said front end includes, at least two of said strap elements extending out from a top edge, and at least two hook elements insertable in and supported in holes in said front end of said box structure and in hook connected through holes provided in respective strap elements.

12. The portable hair shampoo and scalp treatment basin of claim 11, wherein a plurality of strap elements are mounted to project out from an end edge of said removeable top, and also a plurality of strap elements are mounted to project out from a side edge of said removeable top so that said removeable top may be selectively connected to the front end of said box structure as a user back rest for different size individuals.

13. The portable hair shampoo and scalp treatment basin of claim 12, wherein said strap elements are flexible strap elements for mounting convenience.

14. The portable hair shampp and scalp treatment basin of claim 12, wherein a plurality of different height holes are provided in said front end of said box structure for each of said plurality of hook elements to give height adjustment for different size users.

15. The portable hair shampoo and scalp treatment basin of claim 9, wherein a side of said box structure has a side molded cavity and a handle spanning said side molded cavity is fastened to said box structure for convenience in carrying, like luggage, the box in the closed portable state.

16. The portable hair shampoo and scalp treatment basin of claim 15, wherein said two opposite sides and said back end are in the form of substantially vertical walls relative to said box bottom; and at least one of said two opposite sides and said back end have a plurality of keyed openings sized and shaped to receive and hold mount the box structure with large head screws mounted in such as walls in the close quarters of kitchens, bathrooms, utility rooms, resthomes and hospitals.

* * * * *